US010932599B1

(12) United States Patent
Jackson, III et al.

(10) Patent No.: US 10,932,599 B1
(45) Date of Patent: Mar. 2, 2021

(54) CONSTRUCTIBLE SCOOP

(71) Applicant: Avery M Jackson, III, Grand Blanc, MI (US)

(72) Inventors: Avery M. Jackson, III, Grand Blanc, MI (US); Marc Von Amsberg, Waxhaw, NC (US)

(73) Assignee: Avery M. Jackson, III, Grand Blanc, MI (US)

( * ) Notice: Subject to any disclaimer, the term of this patent is extended or adjusted under 35 U.S.C. 154(b) by 0 days.

(21) Appl. No.: 16/558,371

(22) Filed: Sep. 3, 2019

(51) Int. Cl.
*A47G 21/00* (2006.01)

(52) U.S. Cl.
CPC ..... *A47G 21/00* (2013.01); *A47G 2021/002* (2013.01)

(58) Field of Classification Search
CPC ..... A01K 1/0114; A45F 5/00; E01H 1/1206; B65D 5/36; B65D 5/3692; B65D 5/46; B65D 71/28; B65D 71/00432; A47G 21/00; A47G 2021/002
USPC ..... 294/1.3–1.5, 25, 55; 15/257.1, 257.6; 229/117.01, 117.03, 117.09, 117.12
See application file for complete search history.

(56) References Cited

U.S. PATENT DOCUMENTS 652,350 A 6/1900 Davenport
1,931,213 A 10/1933 Wheeler
4,247,139 A * 1/1981 Grieb ..... E01H 1/1206 294/1.4
4,804,133 A * 2/1989 Kiyokane ..... G09F 1/08 206/457
5,301,870 A 4/1994 Smith et al.
5,626,283 A * 5/1997 Mellon ..... B65D 5/18 229/120.13
5,950,341 A 9/1999 Cross
6,068,181 A * 5/2000 Cai ..... B65D 31/005 206/431
7,472,668 B2 * 1/2009 Lau ..... E01H 1/1206 119/867
8,210,381 B2 7/2012 Cross
8,511,500 B2 * 8/2013 Teys ..... B65D 17/4014 220/265
9,387,952 B2 * 7/2016 Kaltman ..... B65D 5/2047
9,625,302 B2 4/2017 Inglis
2005/0258655 A1 11/2005 Matthews et al.
2014/0238987 A1 8/2014 Brooks

* cited by examiner

*Primary Examiner* — Stephen A Vu
(74) *Attorney, Agent, or Firm* — McNees Wallace & Nurick LLC

(57) ABSTRACT

A constructible scoop is provided as a sheet of planar flexible material having front and back surfaces and bilateral symmetry along a center line that extends from a top edge through a bottom edge. The sheet includes elongate extensions that emanate from a center body, and include left and right lateral extensions, a base extension that terminates at the bottom edge of the sheet and is oriented at ninety degrees relative to the left and right lateral extensions, an optional handle extension that terminates at the top edge of the sheet opposite the base extension. The extensions form a periphery that is shaped so that each extension may be flexed from a planar configuration to a three-dimensional configuration and fixedly engaged to form a scoop having a backwall, opposing sidewalls, a receptacle, and a spout.

20 Claims, 6 Drawing Sheets

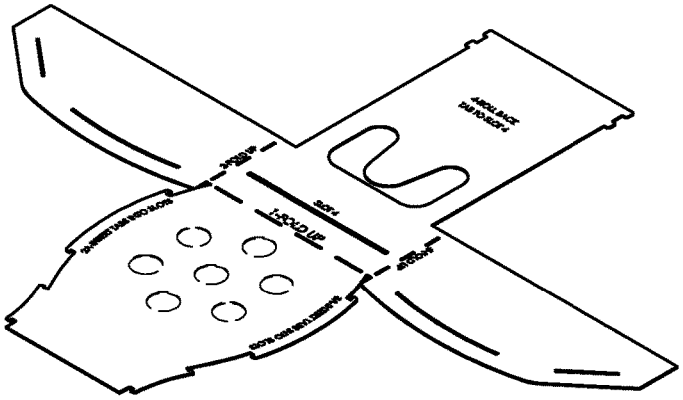
FIG. 15
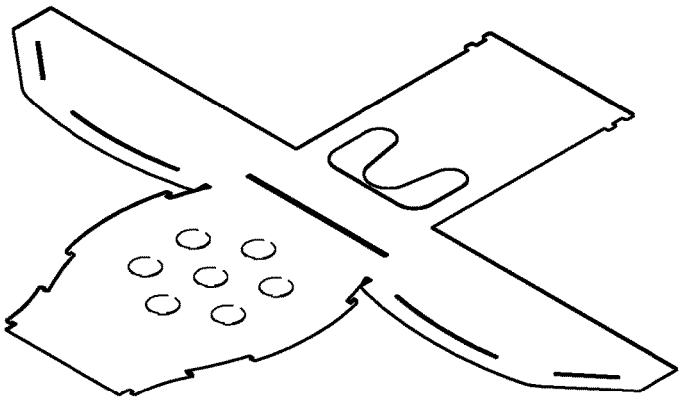
FIG. 16
FIG. 17
FIG. 18

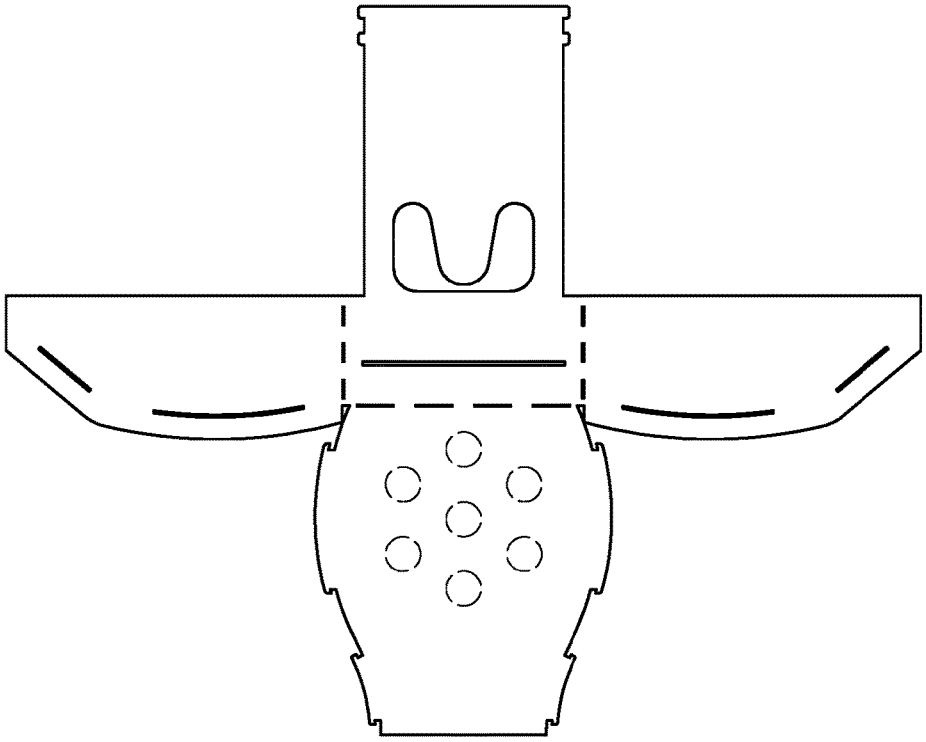
FIG. 19
FIG. 20
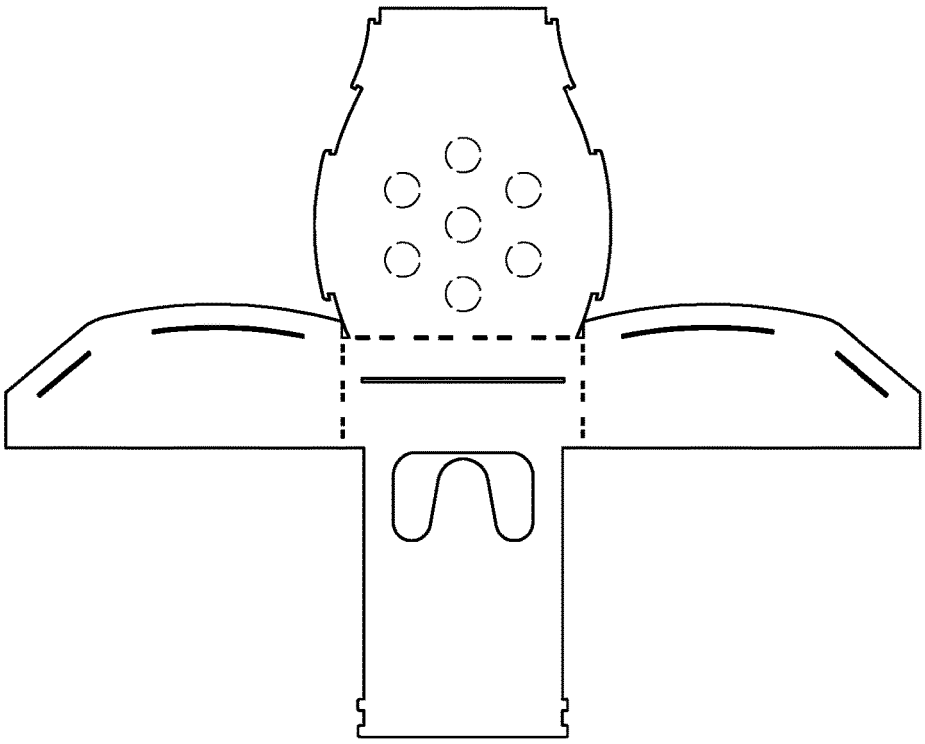
FIG. 21
FIG. 22

CONSTRUCTIBLE SCOOP

BACKGROUND

This invention relates to a utensil that is conveniently constructible from a planar sheet into a scoop for scooping and dispensing material.

Many products are provided in bulk packaging wherein the material contents of the packaging is may be dispensed in units or aliquots over time. In one example, snacks, such as popcorn, chips and candy may be provided in single or multi-serving containers into which a consumer may be required to repeatedly reach in order to access the contents for consumption or use. In some instances, the containers are shared by multiple consumers of the material, or the materials are accessed over a period of time. In some instances, the material includes coatings and other surface-transferrable materials, such as salt, oils and flavored coatings, in the case of comestibles, or chemicals, particulates and coatings, in the case of non-comestibles that can render the consumer's hands as soiled. Thus, there is need for convenient, compact utensils that can be used for repeatedly sampling the contents of the container for consumption to avoid unwanted contact of the contents with the hands of the one or more consumers.

The instant disclosure provides a scooping utensil that is provided as a flat sheet, for example with or attached to a container of material to be scooped and dispensed, the sheet being foldable by a user to form a scoop. More generally, the scooping utensil may be provided as a convenient co-package or supplemental package component with other products, such as, but not limited to, pet comestibles, staples such as rice, beans, pasta and other comestible materials, and non-comestible products including household products that may be dispensed for consumption over time.

SUMMARY

This invention relates generally to a scoop that is constructible from a planar sheet of flexible material. More specifically, the invention relates to a constructible scoop that includes: a sheet of planar flexible material having front and back surfaces and bilateral symmetry along a center line that extends from a top edge through a bottom edge of the sheet. The sheet includes elongate extensions that emanate from a center body, the extensions including left and right lateral extensions, and a base extension that terminates at the bottom edge of the sheet and is oriented at ninety degrees relative to the left and right lateral extensions. Optionally, the sheet includes a handle extension that emanates from an upper edge of the center body and along the center line and oriented at ninety degrees relative to the left and right lateral extensions. The extensions form a periphery that is shaped so that each extension may be flexed from a planar configuration to a three-dimensional configuration, and each of the lateral extensions is adapted to be fixedly engaged when flexed to form a scoop having a backwall, opposing sidewalls, a receptacle, and a spout. It will be understood that each of the extensions when flexed forms one or more of the features of the scoop; thus the backwall is formed by the center body, the sidewalls are formed by the left and right lateral extensions, and the receptacle and spout are formed by the base extension which provides the structural base of the scoop. In some embodiments, each of the left and right lateral and base extensions is flexed towards the front surface of the sheet to form the scoop. In some embodiments, each of the extensions is flexed towards the front surface of the sheet to about 90°. In some embodiments, one or more of the extensions includes a score adjacent the center body. In some embodiments, the generally planar flexible material includes or is formed with paper.

In some embodiments, each of the left and right lateral extensions includes an upper edge that is generally rectilinear and a lower edge that is convex radiused, and wherein left and right edges of the base extension are convex radiused, the base extension having a generally elliptical contour, wherein when the flexible extensions are flexed, the receptacle of the scoop is curved. In some embodiments, each of the radiused left and right lateral extensions terminates in a beveled tip. According to such embodiments, the spout is elevated relative to the receptacle. In some embodiments, the bottom edge of the base extension defines a lip of the spout, and is one of rectilinear, convex radiused, and concave radiused. In some embodiments, the base extension includes one or a plurality of through holes in the sheet.

In some embodiments, the left lateral extension includes at least one left lateral extension slot, and the right lateral extension includes at least one right lateral extension slot, each slot oriented generally perpendicular to the center line, and the base extension includes at least one left base extension tab and one right base extension tab, each base extension tab extending respectively from each of left and right base extension edges, each of the left and right lateral extension slots and left and right base extension tabs arranged to align when the extensions are flexed and engagable to fixedly assemble the scoop.

In some embodiments each of the left and right lateral extensions includes a plurality of slots and the left and right edges of the base extension each includes a plurality of tabs. In certain embodiments, at least one slot is on a beveled tip of each of the left and right lateral extensions and opposing tabs are on the left and right edges of the base extension.

In some embodiments, each of the center body, and the left and right lateral and base extensions has a shape that is one of square and rectangular. In some embodiments, each of the center body, and the left and right lateral and base extensions has a shape that rectangular.

In some embodiments, the constructible scoop also includes a handle extension that extends from the center body, opposite the base extension, and terminates at the top edge of the sheet, wherein the handle extension includes at its top edge opposing left and right handle extension tabs and wherein the center body includes at least one slot that is perpendicular to the center line, each of the left and right handle extension tabs and the center body slot arranged to align when the handle extension is flexed and engagable to fixedly form a handle on the center body of the scoop.

In accordance with some embodiments, provided is a constructible scoop including: a sheet of planar flexible material having front and back surfaces and bilateral symmetry along a center line that extends from a top edge through a bottom edge, the sheet including elongate extensions that emanate from a center body, the extensions including left and right lateral extensions, and a base extension that terminates at the bottom edge of the sheet and is oriented at ninety degrees relative to the left and right lateral extensions, the extensions forming a periphery that is shaped so that each extension may be flexed from a planar configuration to a three-dimensional configuration, and each of the lateral extensions adapted to be fixedly engaged with the base extension when flexed to form a scoop having a backwall, opposing sidewalls, a receptacle, and a spout. Each of the left and right lateral extensions includes an upper edge that is generally rectilinear and a lower edge that is convex radiused, and wherein the left and right edges of the base extension are convex radiused, the base extension having a generally elliptical contour, wherein when the flexible extensions are flexed, the receptacle of the scoop is curved, and wherein the left lateral extension includes at least one left lateral extension slot, and the right lateral extension includes at least one right lateral extension slot, each slot oriented generally perpendicular to the center line, and the base extension includes at least one left base extension tab and one right base extension tab, each base extension tab extending respectively from each of left and right base extension edges, each of the left and right lateral extension slots and left and right base extension tabs arranged to align when the extensions are flexed and engagable to fixedly assemble the scoop, and wherein each of the left and right lateral and base extensions is flexed towards the front surface of the sheet to form the scoop.

In some embodiments, provided is a constructible scoop including: a sheet of planar flexible material having front and back surfaces and bilateral symmetry along a center line that extends from a top edge through a bottom edge, the sheet including elongate extensions that emanate from a center body, the extensions including left and right lateral extensions, a base extension that terminates at the bottom edge of the sheet, a handle extension that terminates at the top edge of the sheet, the base and handle extensions each oriented at ninety degrees relative to the left and right lateral extensions, the extensions forming a periphery that is shaped so that each extension may be flexed from a planar configuration to a three-dimensional configuration, each of the lateral extensions adapted to be fixedly engaged with the base extension when flexed to form a scoop having a backwall, opposing sidewalls, a receptacle, a spout, and a looped handle.

In some embodiments, the left lateral extension includes at least one left lateral extension slot, the right lateral extension includes at least one right lateral extension slot, each slot oriented generally perpendicular to the center line, and the base extension includes at least one left base extension tab and one right base extension tab, each base extension tab extending respectively from each of left and right base extension edges, each of the left and right lateral extension slots and left and right base extension tabs arranged to align when the extensions are flexed and engagable to fixedly assemble the scoop, and the handle extension includes at its top edge opposing left and right handle extension tabs and wherein the center body includes at least one slot that is perpendicular to the center line, each of the left and right handle extension tabs and the center body slot arranged to align when the handle extension is flexed and engagable to fixedly form a handle on the center body of the scoop; and wherein each of the left and right lateral and base extensions is flexed towards the front surface of the sheet to form the scoop, and the handle extension is flexed towards the back surface of the sheet to form the looped handle.

According to some such embodiments each of the left and right lateral extensions includes a plurality of slots and the left and right edges of the base extension each includes a plurality of tabs. In some such embodiments, each of the left and right lateral extensions includes an upper edge that is generally rectilinear and a lower edge that is convex radiused, and wherein the left and right edges of the base extension are convex radiused, the base extension having a generally elliptical contour, wherein when the flexible extensions are flexed, the receptacle of the scoop is curved.

Other features and advantages of the present invention will be apparent from the following more detailed description, by way of example, the principles of the invention.

This disclosure describes particular embodiments in accordance with the general inventive concepts and is not intended to limit the scope of the invention in any way. Indeed, the invention as described in the specification is broader than and unlimited by the particular embodiments set forth herein, and the terms used herein have their full ordinary meaning.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 15 is a flat top perspective view showing the planer sheet configuration constructible scoop;

FIG. 16 is a flat bottom perspective view showing the planer sheet configuration constructible scoop;

FIG. 17 is a flat front view showing the planer sheet configuration constructible scoop;

FIG. 18 is a flat rear view showing the planer sheet configuration constructible scoop;

FIG. 19 is a flat top view showing the planer sheet configuration constructible scoop;

FIG. 20 is a flat right side view showing the planer sheet configuration constructible scoop;

FIG. 21 is a flat bottom view showing the planer sheet configuration constructible scoop; and FIG. 22 is a flat left side view showing the planer sheet configuration constructible scoop.

REFERENCE NUMBERS

Figure 1:
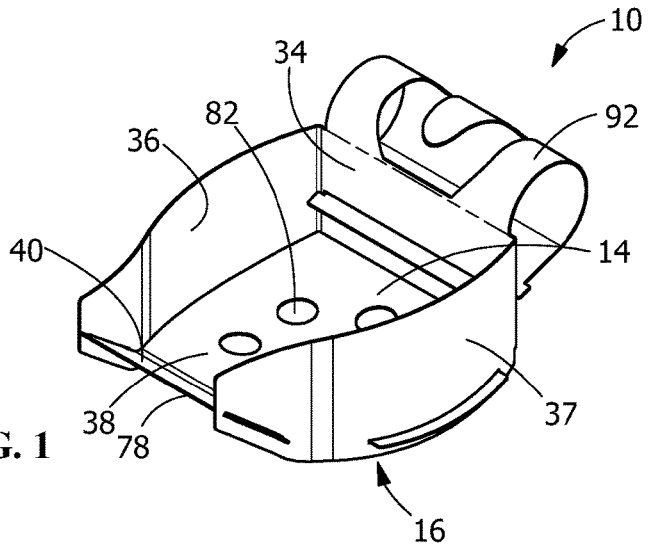
FIG. 1 is a perspective view of an embodiment of a constructible scoop in an assembled configuration.

| | |
|---|---|
| constructible scoop 10 | upper edges 42, 44 |
| sheet 12 | lower edged 46, |
| front surface 14 | radiused 50 |
| back surface 16 | left and right edges 52, 54 |
| center line 18 | convex radiused 56 |
| top edge 20 | elliptical contour 58 |
| bottom edge 22 | beveled tip 60, 62 |
| center body 24 | slots 64, 68 |
| left lateral extension 26 | base extension tabs 70, 72 |
| right lateral extension 28 | lip 78 |
| left and right extension edges 74, 76 | score 80 |
| base extension 30 | hole 82 |
| periphery 32 | handle extension 84 |
| backwall 34 | extension tabs 86, 88 |
| sidewalls 36, 37 | slot 90 |
| receptacle 38 | handle 92 |
| spout 40 | |

DETAILED DESCRIPTION

In accordance with the instant disclosure, a constructible scoop is provided the constructible scoop being configured for manipulation between a first generally planar configuration to a three-dimensional configuration. In various embodiments, the constructible scoop is provided as a flat sheet, for example with or attached to a container of material to be scooped and dispensed, the sheet being foldable by a user to form a scoop.

In accordance with the disclosure in various embodiments, the constructible scoop is formed with a sheet of planar flexible material having a front surface and a back surface and bilateral symmetry along a center line that extends from a top edge through a bottom edge. The sheet includes elongate extensions that emanate from a center body, and include a left lateral extension and a right lateral extension, a base extension that terminates at the bottom edge of the sheet and is oriented at ninety degrees relative to the left and right lateral extensions, an optional handle extension that terminates at the top edge of the sheet opposite the base extension. The extensions form a periphery that is shaped so that each extension may be flexed from a planar configuration to a three-dimensional configuration and fixedly engaged to form a scoop having a backwall, opposing sidewalls, a receptacle, and a spout.

Figure 2:
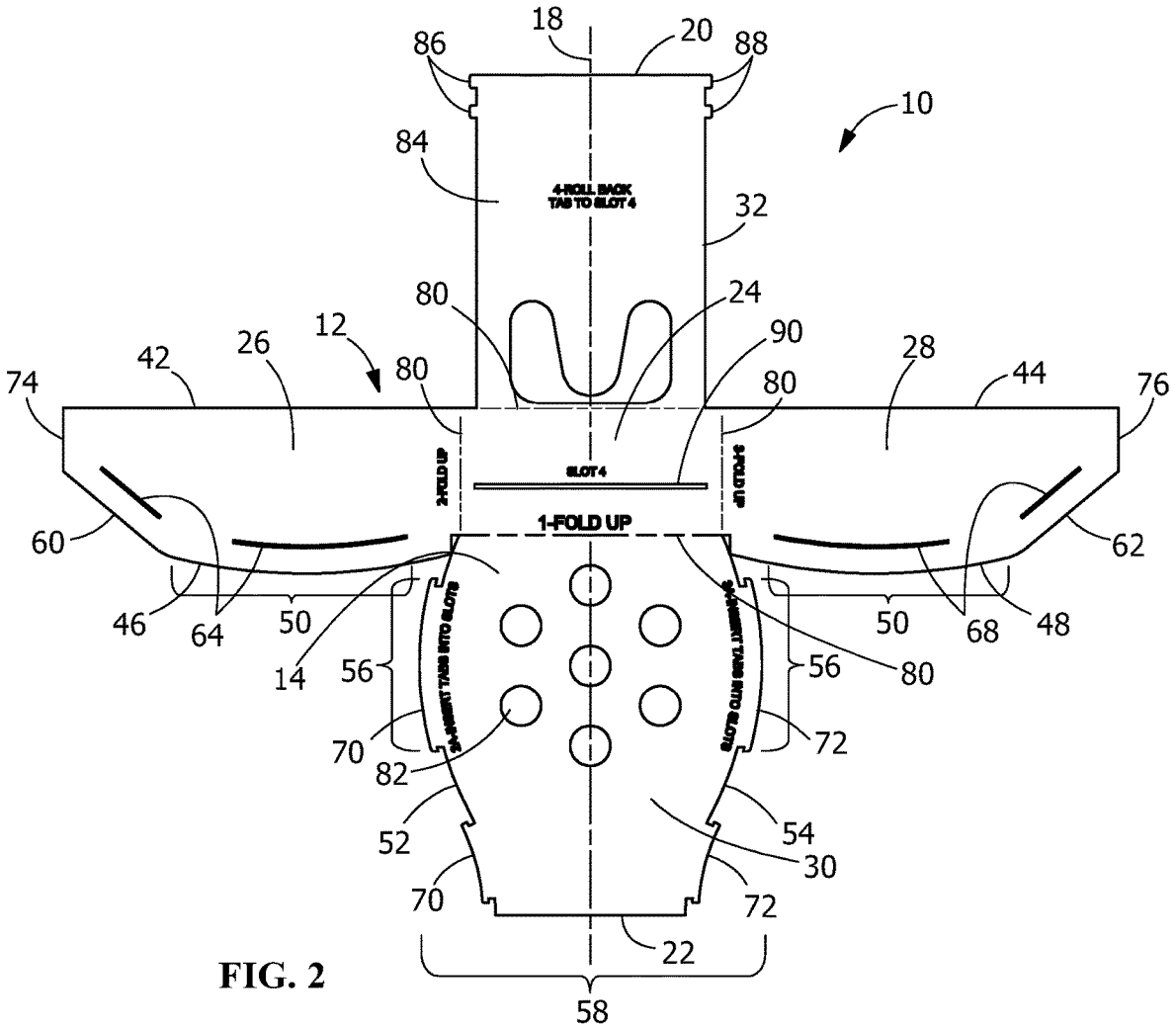
FIG. 2 is a top view of the embodiment of the constructible scoop shown in FIG. 1, in its planar sheet configuration.
Figure 3:
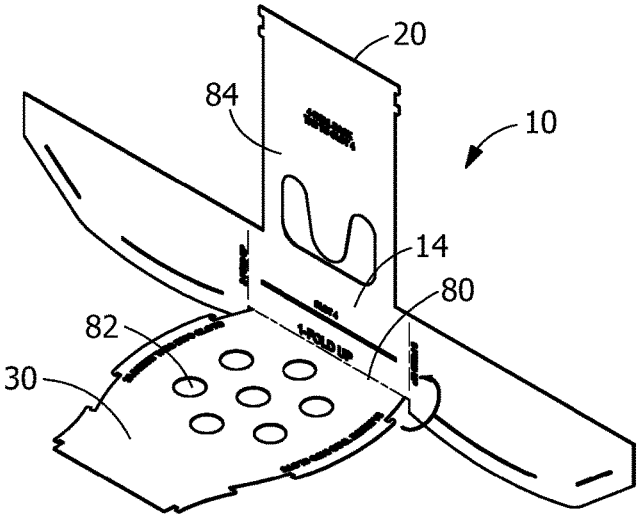
FIG. 3 shows a perspective view of the constructible scoop shown in FIG. 1 depicting a first possible step in forming the scoop from the planar sheet configuration by executing a first fold.
Figure 4:
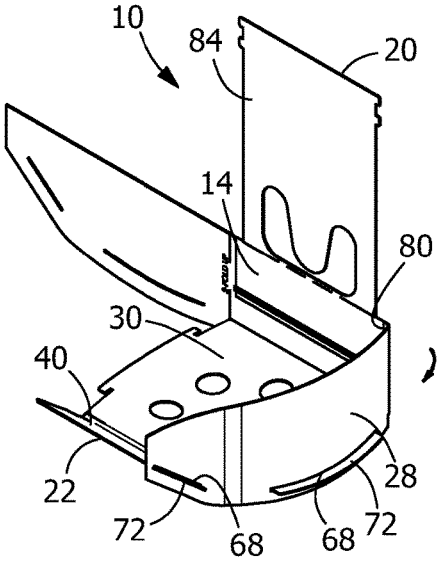
FIG. 4 shows a perspective view of the constructible scoop shown in FIG. 1 depicting a second possible step in forming the scoop from the planar sheet configuration by executing a second fold.
Figure 5:
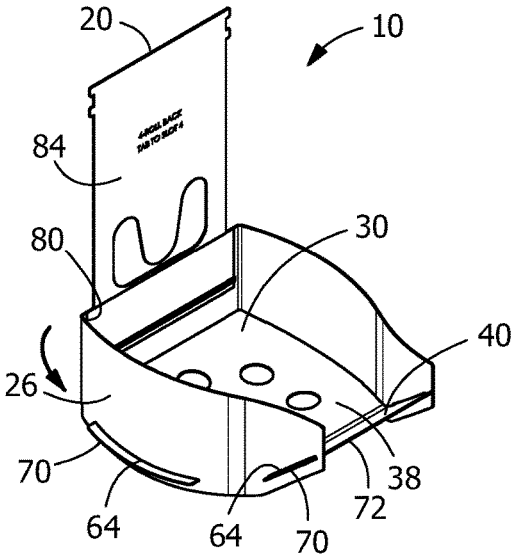
FIG. 5 shows a perspective view of the constructible scoop shown in FIG. 1 depicting a third possible step in forming the scoop from the planar sheet configuration by executing a third fold.
Figure 6:
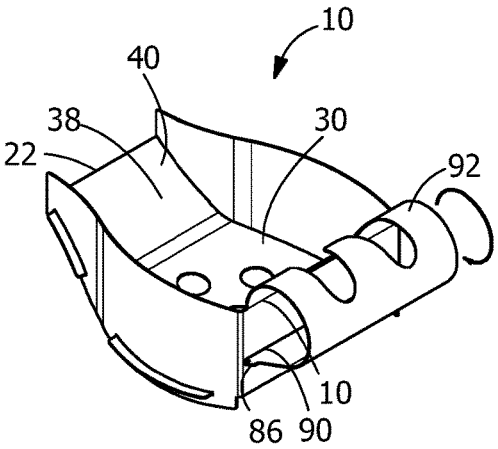
FIG. 6 shows a perspective view of the constructible scoop shown in FIG. 1 depicting a fourth possible step in forming the scoop from the planar sheet configuration by executing a fourth fold.
Figure 7:
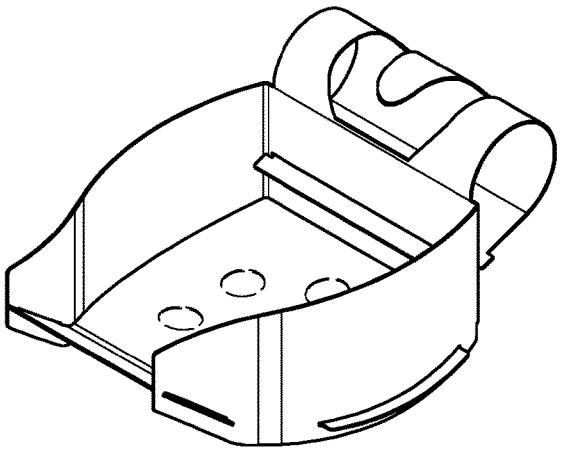
FIG. 7 is an assembled top perspective view showing the assembled constructible scoop.
Figure 8:
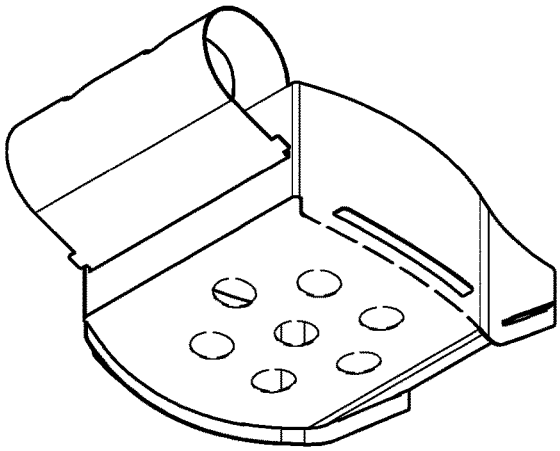
FIG. 8 is an assembled bottom perspective view showing the assembled constructible scoop.
Figure 9:
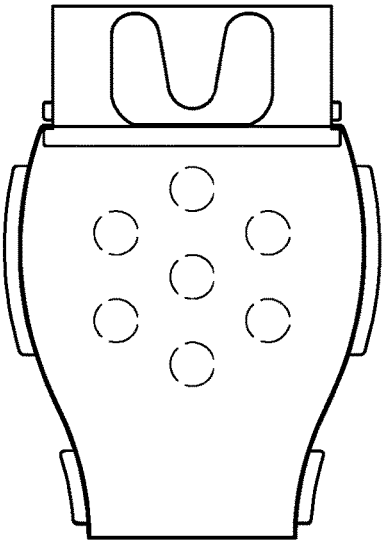
FIG. 9 is an assembled top view showing the assembled constructible scoop.
Figure 10:
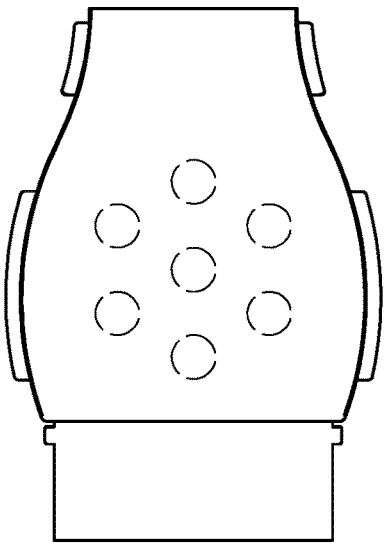
FIG. 10 is an assembled bottom view showing the assembled constructible scoop.
Figure 11:
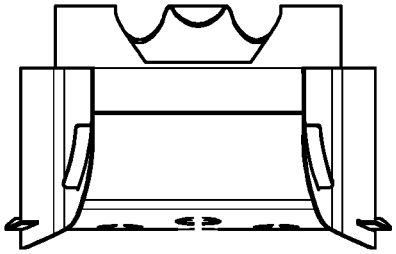
FIG. 11 is an assembled front view showing the assembled constructible scoop.
Figure 12:
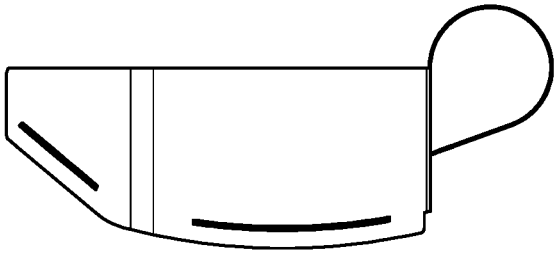
FIG. 12 is an assembled right side view showing the assembled constructible scoop.
Figure 13:
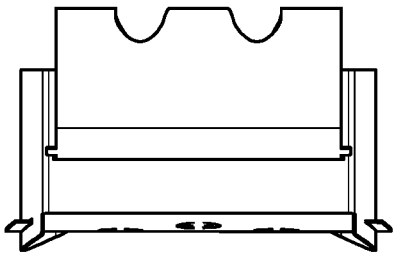
FIG. 13 is an assembled rear view showing the assembled constructible scoop.
Figure 14:
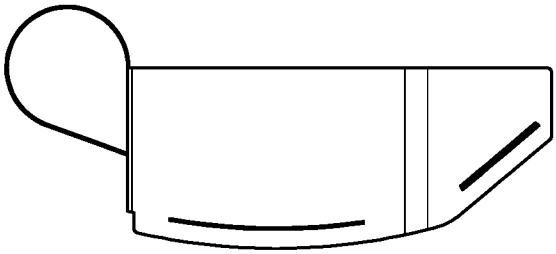
FIG. 14 is an assembled left side view showing the planer sheet configuration constructible scoop.

Referring now to the drawings, FIG. 1 shows a representative embodiment of the constructible scoop 10 in a three-dimensional configuration, which is further detailed in an alternate embodiment in each of FIG. 7-14, and sequential images showing the assembly of which are detailed in FIG. 3-6. FIG. 2 shows the constructible scoop 10 in a planar configuration, which is further detailed in an alternate embodiment in each of FIG. 15-22. Referring again to FIG. 2, the constructible scoop 10 is constructible from a planar sheet 12 of flexible material having a front surface 14 and a back surface 16 and bilateral symmetry along a center line 18 that extends from a top edge 20 through a bottom edge 22 of the sheet 12. In some embodiments, the generally planar flexible material includes or is formed with paper. In some such embodiments, the paper is formed with food safe materials, and may or may not be coated. In other embodiments, the material may be formed of a polymer, or of a metal, or combinations of these. Is some embodiments, the sheet 12 is of unitary construction. In other embodiments, the sheet 12 may be formed of multiple parts that are affixed together by any of a variety of fixation means including sonic welding, glue, tape and the like.

Referring again to FIG. 2, the sheet 12 includes elongate extensions that emanate from a center body 24, the extensions including left lateral extension 26 and a right lateral extension 28, each respectively terminating in left and right extension edges 74, 76, and a base extension 30 that terminates at the bottom edge 22 of the sheet and is oriented at ninety degrees relative to the left and right lateral extensions 26, 28. The extensions form a periphery 32 that is shaped so that each extension may be flexed from a planar configuration to a three-dimensional configuration, and each of the left and right lateral extensions 26, 28 is adapted to be fixedly engaged when flexed to form the three-dimensional configuration of the constructible scoop 10 having a backwall 34, opposing sidewalls 36, 37, a receptacle 38, and a spout 40. In some embodiments, each of the left and right lateral and base extensions is flexed towards the front surface of the sheet to form the scoop. In some embodiments, each of the extensions is flexed towards the front surface of the sheet to about 90°.

In some embodiments, each of the left and right lateral extensions 26, 28 includes an upper edge 42, 44 that is generally rectilinear and a lower edge 46, 48 that is convex radiused 50, and wherein the left and right edges 52, 54 of the base extension 30 are convex radiused 56, the base extension 30 having a generally elliptical contour 58, wherein when the flexible extensions are flexed, the receptacle 38 of the constructible scoop 10 is curved. According to such embodiments, the constructible scoop 10 receptacle 38 is recessed rather than planar and thus adapted to enhance retention of materials therein. In some embodiments, each of the convex radiused 50 left and right lateral extensions 26, 28 terminates in a beveled tip 60, 62. According to such embodiments, the constructible scoop 10 spout 40 is angled upward relative to the receptacle 38 to enhance retention of materials in the receptacle 38 until the constructible scoop 10 is tilted by the user to dispense the contained materials. In some embodiments, as depicted in the drawings, the left and right extension edges 74, 76 are rectilinear, and essentially parallel with the center line 18 of the sheet 12 in the planar configuration. In other embodiments, the left and right extension edges 74, 76 may be beveled, concave radiused or convex radiused.

In some embodiments, the left lateral extension includes at least one left lateral extension slot 64, and the right lateral extension includes at least one right lateral extension slot 68, each slot 64, 68 oriented generally perpendicular to the center line 18, and the base extension 30 includes at least one left base extension tab 70 and one right base extension tab 72, each base extension tab 70, 72 extending respectively from each of the left base extension edge 52 and the right base extension edge 54, each of the left and right lateral extension slots 64, 68 and left and right base extension tabs 70, 72 arranged to align when the respective left and right lateral and base extensions 26, 28, 30 are flexed and engagable to fixedly assemble the constructible scoop 10. In some embodiments each of the left and right lateral extensions 26, 28 includes a plurality of slots 64, 68 and the left and right edges 52, 54 of the base extension 30 each includes a plurality of tabs 70, 72. In some particular embodiments, specifically as shown in the representative embodiment in the drawings, each of the left and right lateral extensions 26, 28 includes at least one slot 64, 68 on the beveled tip 60, 62 portion of their lower edges 46, 48, and at least one other slot 64, 68 on the radiused portion 50 of their lower edges 46, 48, and the left and right edges 52, 54 of the base extension 30 each includes a plurality of tabs 70, 72 for corresponding engagement with the plurality of slots 64, 68.

In some embodiments, the base extension 30 includes one or a plurality of through holes 82 in the sheet 12. In use, a through hole 82 provides the option of allowing the user to sift small particles, seeds, and the like from the material collected within the receptacle 38. In some embodiments, one or more of the extensions includes a score 80 adjacent the center body 24 to facilitate flexing and optionally inducing a fold for assembly. In some embodiments, the bottom edge 22 of the base extension 30 defines a lip 78 of the spout 40, and is one of rectilinear, convex radiused, and concave radiused.

In some embodiments, each of the center body 24, and the left and right lateral and base extensions has a shape that is one of square and rectangular. In some embodiments, each of the center body 24, and the left and right lateral and base extensions 26, 28, 30 has a shape that rectangular.

In some embodiments, the constructible scoop 10 also includes a handle extension 84 that extends from the center body, opposite the base extension, and terminates at the top edge 20 of the sheet, wherein the handle extension 84 includes at its top edge 20 a left handle extension tab 86 and an opposing right handle extension tab 88 and wherein the center body 24 includes at least one slot 90 that is perpendicular to the center line 18, each of the left and right handle extension tabs 86, 88 and the center body slot 90 arranged to align when the handle extension 84 is flexed and engagable to fixedly form a handle 92 on the center body 24 of the constructible scoop 10. In some particular embodiments, the handle extension 84 includes at its top edge 20 a plurality of left handle extension tabs 86 and a plurality of opposing right handle extension tabs 88.

Referring now to FIG. 3-FIG. 6, a series of images of the constructible scoop 10 are shown, each image showing the sequential transformation in configuration of the constructible scoop 10 from planar to three dimensional by flexing and folding each of the handle, left and right lateral and base extensions 84, 26, 28, 30. In the embodiment depicted in the drawings, each of the left and right lateral and base extensions 26, 28, 30 is flexed towards the front surface 14 of the sheet 12 to form the scoop receptacle 38 and spout 40, and the handle extension 84 is flexed towards the back surface 16 of the sheet 12 to form the handle 92. As depicted, each of the left and right lateral and base extensions 26, 28, 30 is flexed towards the front surface 14 of the sheet to about 90°. In alternate embodiments, the sheet 12 may not include a handle extension 84.

In accordance with the various embodiments, the constructible scoop 10 may be provided as a single product, or in a package that includes a plurality of sheets 12, or it may be provided as an removable part of a package, for example affixed or integrated into a wall of a cardboard popcorn container, such as are provided in some movie venues. In some other examples, the sheet 12 may be integrated into a wall of a cereal box. In yet other embodiments, the sheet 12 may be provided inside a package of material that may be a human or pet comestibles, food staples, or a dispensable product such as soap powder, cleaning pods, and the like. The sheets 12 may include indicia providing instructions for folding and engagement of tabs and slots. In some embodiments, the constructible scoop 10 may include a handle or may be free of a handle.

As used herein, the singular forms "a," "an," and "the" are intended to include the plural forms as well, unless the context clearly indicates otherwise. Unless otherwise indicated, all numbers expressing quantities, properties, and so forth as used in the specification, drawings and claims are to be understood as being modified in all instances by the term "about." Accordingly, unless otherwise indicated, the numerical properties set forth in the specification and claims are approximations that may vary depending on the suitable properties desired in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed.

Those skilled in the art may readily adopt one or more of the inventive aspects, concepts and features into additional embodiments and uses within the scope of the general inventive concepts, even if such embodiments are not expressly disclosed herein. Additionally, even though some features, concepts and aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated.

Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A constructible scoop comprising:

a sheet of planar flexible material having front and back surfaces and bilateral symmetry along a center line that extends from a top edge through a bottom edge, the sheet comprising elongate extensions that emanate from a center body, the extensions comprising left and right lateral extensions, and a base extension that terminates at the bottom edge of the sheet and is oriented at ninety degrees relative to the left and right lateral extensions, the extensions forming a periphery that is shaped so that each extension may be flexed from a planar configuration to a three-dimensional configuration, and each of the lateral extensions adapted to be fixedly engaged with the base extension when flexed to form a scoop having a backwall, opposing sidewalls, a receptacle, and a spout, wherein the bilateral symmetry indicates that all structural portions of the sheet of planar flexible material on either sides of the center line are mirror images of one another, and wherein the top edge of the sheet of planar flexible material is a first furthest extreme of the constructible scoop along the center line and the bottom edge of the sheet of planar flexible material is a second furthest extreme of the sheet of planar flexible material along the center line such that no portion of the sheet of planar flexible material extends outward along the center line beyond the top edge and the bottom edge.

2. The constructible scoop according to claim 1, wherein each of the left and right lateral extensions comprises an upper edge that is generally rectilinear and a lower edge that is convex radiused, and wherein the left and right edges of the base extension are convex radiused, the base extension having a generally elliptical contour, wherein when the flexible extensions are flexed, the receptacle of the scoop is curved.

3. The constructible scoop according to claim 2, wherein each of the radiused left and right lateral extensions terminates in a beveled tip.

4. The constructible scoop according to claim 1, wherein each of the left and right lateral and base extensions is flexed towards the front surface of the sheet to form the scoop.

5. The constructible scoop according to claim 4, wherein each of the extensions is flexed towards the front surface of the sheet to about 90°.

6. The constructible scoop according to claim 3, wherein the bottom edge of the base extension defines a lip of the spout, and is one of rectilinear, convex radiused, and concave radiused.

7. The constructible scoop according to claim 1, wherein the left lateral extension comprises at least one left lateral extension slot, and the right lateral extension comprises at least one right lateral extension slot, each slot oriented generally perpendicular to the center line, and the base extension comprises at least one left base extension tab and one right base extension tab, each base extension tab extending respectively from each of left and right base extension edges, each of the left and right lateral extension slots and left and right base extension tabs arranged to align when the extensions are flexed and engagable to fixedly assemble the scoop.

8. The constructible scoop according to claim 1, wherein one or more of the extensions includes a score adjacent the center body.

9. The constructible scoop according to claim 1, wherein the generally planar flexible material comprises paper.

10. The constructible scoop according to claim 1, wherein each of the center body, and the left and right lateral and base extensions has a shape that is one of square and rectangular.

11. The constructible scoop according to claim 1, wherein each of the center body, and the left and right lateral and base extensions has a shape that rectangular.

12. The constructible scoop according to claim 1, wherein the base extension comprises one or a plurality of through holes in the sheet.

13. The constructible scoop according to claim 1, further comprising a handle extension that extends from the center body, opposite the base extension, and terminates at the top edge of the sheet, wherein the handle extension comprises at its top edge opposing left and right handle extension tabs and wherein the center body comprises at least one slot that is perpendicular to the center line, each of the left and right handle extension tabs and the center body slot arranged to align when the handle extension is flexed and engagable to fixedly form a handle on the center body of the scoop.

14. A constructible scoop comprising:

a sheet of planar flexible material having front and back surfaces and bilateral symmetry along a center line that extends from a top edge through a bottom edge, the sheet comprising elongate extensions that emanate from a center body, the extensions comprising left and right lateral extensions, and a base extension that terminates at the bottom edge of the sheet and is oriented at ninety degrees relative to the left and right lateral extensions, the extensions forming a periphery that is shaped so that each extension may be flexed from a planar configuration to a three-dimensional configuration, and each of the lateral extensions adapted to be fixedly engaged with the base extension when flexed to form a scoop having a backwall, opposing sidewalls, a receptacle, and a spout, wherein each of the left and right lateral extensions comprises an upper edge that is generally rectilinear and a lower edge that is convex radiused, and wherein the left and right edges of the base extension are convex radiused, the base extension having a generally elliptical contour, wherein when the flexible extensions are flexed, the receptacle of the scoop is curved, and wherein the left lateral extension comprises at least one or a plurality of left lateral extension slots, and the right lateral extension comprises at least one or a plurality of right lateral extension slots, each slot oriented generally perpendicular to the center line, and the base extension comprises at least one or a plurality of left base extension tabs and at least one or a plurality of right base extension tabs, each base extension tab extending respectively from each of left and right base extension edges, each of the left and right lateral extension slots and left and right base extension tabs arranged to align when the extensions are flexed and engagable to fixedly assemble the scoop, and wherein each of the left and right lateral and base extensions is flexed towards the front surface of the sheet to form the scoop.

15. A constructible scoop comprising:

a sheet of planar flexible material having front and back surfaces and bilateral symmetry along a center line that extends from a top edge through a bottom edge, the sheet comprising elongate extensions that emanate from a center body, the extensions comprising left and right lateral extensions, a base extension that terminates at the bottom edge of the sheet, a handle extension that terminates at the top edge of the sheet, the base and handle extensions each oriented at ninety degrees relative to the left and right lateral extensions, the extensions forming a periphery that is shaped so that each extension may be flexed from a planar configuration to a three-dimensional configuration, each of the lateral extensions adapted to be fixedly engaged with the base extension when flexed to form a scoop having a backwall, opposing sidewalls, a receptacle, a spout, and a looped handle, the looped handle looping about an axis of rotation parallel to the backwall and fixedly engaging with the backwall.

16. The constructible scoop according to claim 15, wherein the left lateral extension comprises at least one or a plurality of left lateral extension slots, and the right lateral extension comprises at least one or a plurality of right lateral extension slots, each slot oriented generally perpendicular to the center line, and the base extension comprises at least one or a plurality of left base extension tabs and at least one or a plurality of right base extension tabs, each base extension tab extending respectively from each of left and right base extension edges, each of the left and right lateral extension slots and left and right base extension tabs arranged to align when the extensions are flexed and engagable to fixedly assemble the scoop, and wherein the handle extension comprises at its top edge opposing left and right handle at least one or a plurality of extension tabs and wherein the center body comprises at least one or a plurality of slots oriented generally perpendicular to the center line, each of the left and right handle extension tabs and each center body slot arranged to align when the handle extension is flexed and engagable to fixedly form a handle on the center body of the scoop; and wherein each of the left and right lateral and base extensions is flexed towards the front surface of the sheet to form the scoop, and the handle extension is flexed towards the back surface of the sheet to form the looped handle.

17. The constructible scoop according to claim 15, wherein each of the left and right lateral extensions comprises an upper edge that is generally rectilinear and a lower edge that is convex radiused, and wherein the left and right edges of the base extension are convex radiused, the base extension having a generally elliptical contour, wherein when the flexible extensions are flexed, the receptacle of the scoop is curved.

18. The constructible scoop according to claim 17, wherein each of the radiused left and right lateral extensions terminates in a beveled tip.

19. The constructible scoop according to claim 15, including any one or more of the features selected from the following:

i. wherein each of the extensions is flexed towards a surface of the sheet to about 90°;

ii. wherein the bottom edge of the base extension defines a lip of the spout, and is one of rectilinear, convex radiused, and concave radiused;

iii. wherein one or more of the extensions includes a score adjacent the center body;

iv. wherein each of the center body, and the left and right lateral and base extensions has a shape that is one of square and rectangular;

v. wherein each of the center body, and the left and right lateral and base extensions has a shape that rectangular;

vi. wherein the base extension comprises one or a plurality of through holes in the sheet; and vii. wherein the handle extension comprises an aperture through the sheet and a flexible flap within the aperture.

20. The constructible scoop according to claim 15, wherein the generally planar flexible material comprises paper.

* * * * *